US006656005B2

(12) United States Patent
Meyerhoffer

(10) Patent No.: US 6,656,005 B2
(45) Date of Patent: Dec. 2, 2003

(54) WATER SPORTS BOARD

(76) Inventor: Thomas Meyerhoffer, 1241 Main St., Montara, CA (US) 94037

( * ) Notice: Subject to any disclaimer, the term of this patent is extended or adjusted under 35 U.S.C. 154(b) by 0 days.

(21) Appl. No.: 10/124,730

(22) Filed: Apr. 18, 2002

(65) Prior Publication Data

US 2003/0199213 A1 Oct. 23, 2003

(51) Int. Cl.[7] ..... B63B 1/00
(52) U.S. Cl. ..... 441/65; 441/74
(58) Field of Search ..... 114/123, 219; 441/65, 74, 79

(56) References Cited

U.S. PATENT DOCUMENTS

| | | | | | |
|---|---|---|---|---|---|
| 4,598,659 | A | * | 7/1986 | Chinnery | 441/74 |
| 4,619,619 | A | | 10/1986 | Muse, Jr. | |
| 4,929,207 | A | * | 5/1990 | Piatt | 441/65 |
| 5,174,220 | A | | 12/1992 | Skedeleski et al. | |
| 5,328,397 | A | | 7/1994 | Whitty | |
| 5,464,359 | A | | 11/1995 | Whitty | |
| 5,476,403 | A | | 12/1995 | Hsia | |
| D377,072 | S | | 12/1996 | Ilejay | |
| 5,672,081 | A | | 9/1997 | Whitty | |
| 5,711,692 | A | | 1/1998 | Pope | |
| 5,810,630 | A | * | 9/1998 | Saghri | 441/65 |
| 5,975,974 | A | | 11/1999 | McCausland | |
| 6,012,734 | A | * | 1/2000 | Skedeleski | 280/610 |
| 6,168,486 | B1 | * | 1/2001 | Lin | 441/76 |

FOREIGN PATENT DOCUMENTS

| | | | | |
|---|---|---|---|---|
| EP | 0 061 878 | * | 10/1982 | 441/65 |
| GB | 2 336 132 | | 10/1999 | |

* cited by examiner

*Primary Examiner*—Stephen Avila
(74) *Attorney, Agent, or Firm*—Fenwick & West LLP

(57) ABSTRACT

A water sports board includes at least a main body panel, and two rail panels, one each removably connected either side of a rear portion of the main body panel, the two rail panels changeable to alter the shape of the board.

27 Claims, 3 Drawing Sheets

WATER SPORTS BOARD

BACKGROUND OF THE INVENTION

1. Field of the Invention

The invention relates to water sports boards, and in particular the invention relates to surfboards, but is also applicable to boogie boards, knee boards, wake boards and the like.

2. Background Information

Water sports are very popular. One particular type of water sport includes transversing the surface of water on a board. One form of this sport involves being towed by a motorboat, for example knee boarding and wake boarding. Another form uses waves as a form of propulsion, for example surfing. Yet a further examples of this type of water sport is windsurfing and Kite boarding which use wind as a form of propulsion.

The handling and performance of the boards used in the above sports is related to the board shape and materials. A board suitable for a more advanced rider is not necessarily suitable for a beginner thus as a new rider's skill and ability increases they will need to regularly update their board. Furthermore, a rider may desire different board handling characteristics for different riding situations and/or water/wave conditions. Thus they may need more than one board.

SUMMARY OF THE INVENTION

It is an object of the present invention to provide a water sports board that is adaptable to different performance and/or handling characteristics, or which at least provides the public with a useful alternative.

According to a first aspect the invention provides a water sports board including a main body panel, and one or more other panels removably connected to said main body panel and changeable to alter the shape of the board.

Preferably, the board includes the main body panel, and at least two rail panels one each removably connected either side of a rear portion of the main body panel.

Preferably, the board includes the main body panel, at least two rail panels one each removably connected either side of a rear portion of the main body panel, and a nose panel connected to a front portion of the main body panel.

According to a second aspect the invention provides a water sports board including a main body panel, and at least two rail panels, one each removably disposed either side of a rear portion of the main body panel, and wherein the rail panels are changeable to alter the shape of the board.

Preferably, the main body panel includes a main body portion and an elongate core portion disposed along the longitudinal centerline of the main body portion.

Preferably, a nose panel made of a soft material is disposed at the front of the main body panel.

Preferably, one or more panels include a transparent portion.

Preferably, any panel, or portion of the panel, is made of a soft material.

Preferably, the board includes one or more removably connected fins.

Preferably, the rail panels each include a fin.

Preferably, the rail panels are removably connected by loops, snaps, screws or glue.

Further aspects of the invention will become apparent from the following description, which is given by way of example only.

BRIEF DESCRIPTION OF THE DRAWINGS

Embodiments of the invention will now be described with reference to the accompanying drawings in which.

DESCRIPTION OF THE PREFERRED EMBODIMENTS

The invention will now be described by way of the preferred embodiment, which is a surfboard. However, this is not to be considered limiting to the invention which may also be applied to other water sport boards such as knee boards wake boards, boogie boards, windsurfing boards etc. The invention will also be described with reference to a short board as shown in FIG. 1, however the invention is equally applicable to long boards as shown in FIG. 2.

Figure 1:
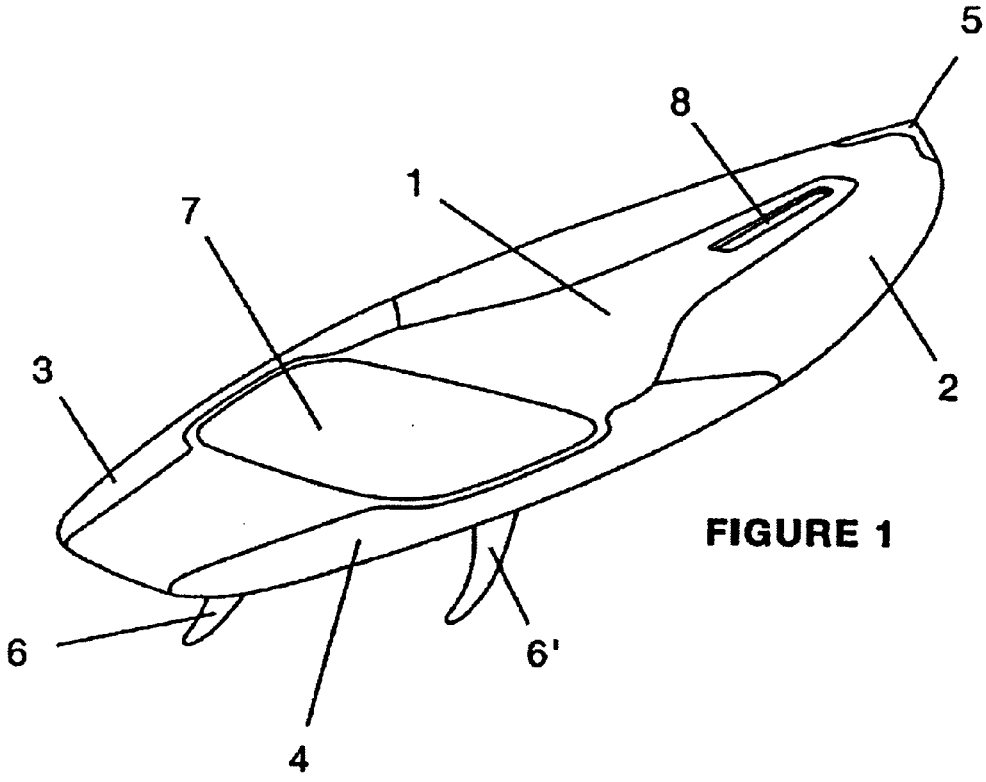
FIG. 1 illustrates a first embodiment of a water sports board according to the invention.
Figure 2:
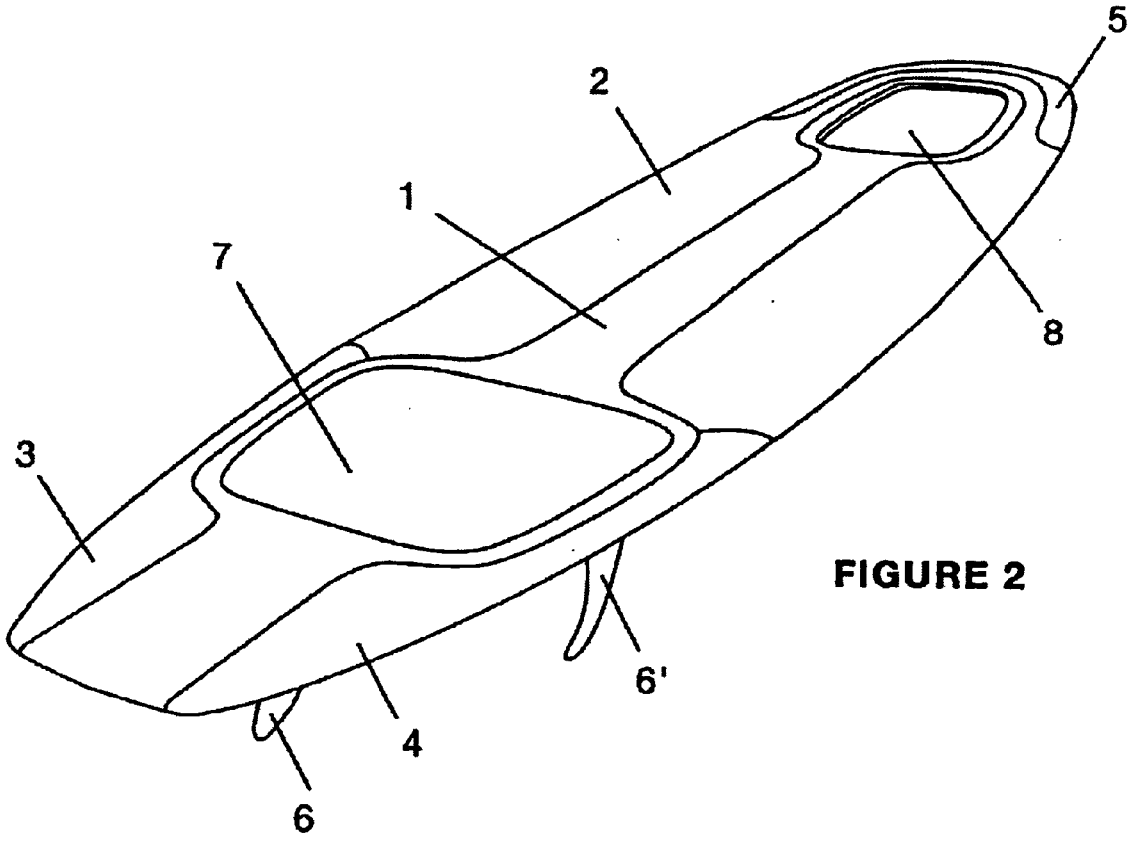
FIG. 2 illustrates a second embodiment of a water sports board according to the invention.
Figure 3:
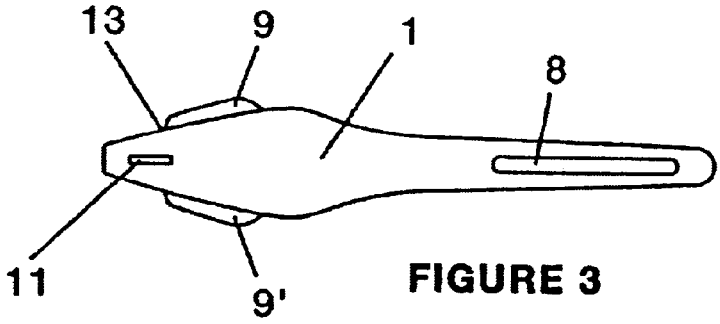
FIG. 3 illustrates a bottom view of a core panel for the water sports board in FIG. 1.
Figure 4:
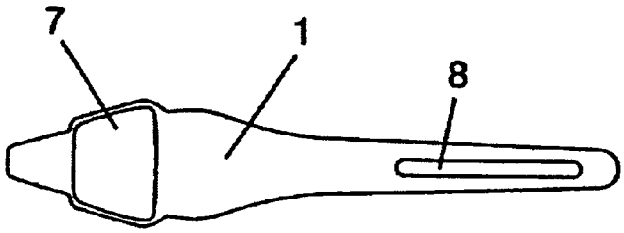
FIG. 4 illustrates a top view of the core panel.
Figure 5:
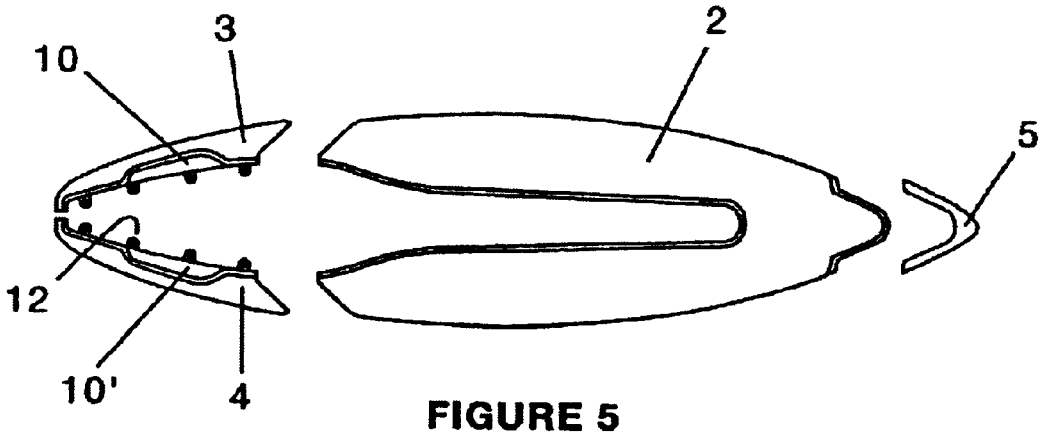
FIG. 5 illustrates a main body panel, nose panel and rail panels for the water sports board.
Figure 6:
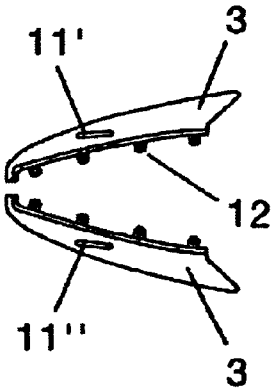
FIG. 6 illustrates a bottom view of the rail panels.

Referring to FIG. 1, a surfboard according to the invention includes a main body comprising an elongate core panel 1, a main body panel 2, a nose panel 5 disposed at the front of the main body panel 2, two rail panels 3, 4 disposed either side of the rear portion of the elongate core panel 1, and three fins 6. Included in the rear portion of core panel 1 is a foot portion 7, and included in the front portion of core panel 1 is a transparent panel 8. Transparent panel 8 allows an underwater view while paddling out, and provides the board with a lighter feeling.

The core panel 1 may be made of flexible materials, such as plastics and/or composites, to provide a flexible characteristic similar to that known in water and snow skis. This will enables the board to be tuned for different performance characteristics.

Referring now to FIGS. 3 to 6, the panels of the surfboard are shown individually. The individual panels of the board are made of foam covered in composite plastic material. In alternative embodiments the foam is covered in polyester, epoxy or other known materials.

The main body, that is the core panel 1 and main body panel 2, are mounted together into one unit in the manufacturing process. This allows the manufacture of a number of different boards by combining different core panels 1 and main body panels 2.

In an alternative embodiment the main body of the surfboard is made as a single panel of foam covered in composite plastic material in known manner. It may also be made in multiple portions for ease of manufacture.

Foot portion 7 of core panel 1 has wing portions 9 that extend beyond the upper edge of the rear portion of core panel 1. The wing portions 9 of core panel 1 locate within recessed sections 10 of rail portions 3, 4 when located together. The wing portions 9 transfer the pressure/weight of the rider into the rail panels 3, 4 during turns.

On the underside of core panel 1 and rail panels 3, 4 are elongate slots 11 for receiving fins 6. In the preferred embodiment there are three fins 6, one each on the rail panels 3, 4 and a center fin on core panel 1. In alternative embodiments there are either one or two fins. In these alternative embodiments the fins are mounted to the board in any one of the following ways: integrated with the rail panels 3, 4, removably mounted to core panel 1, or removably mounted to the rail panels 3, 4.

Figure 7:
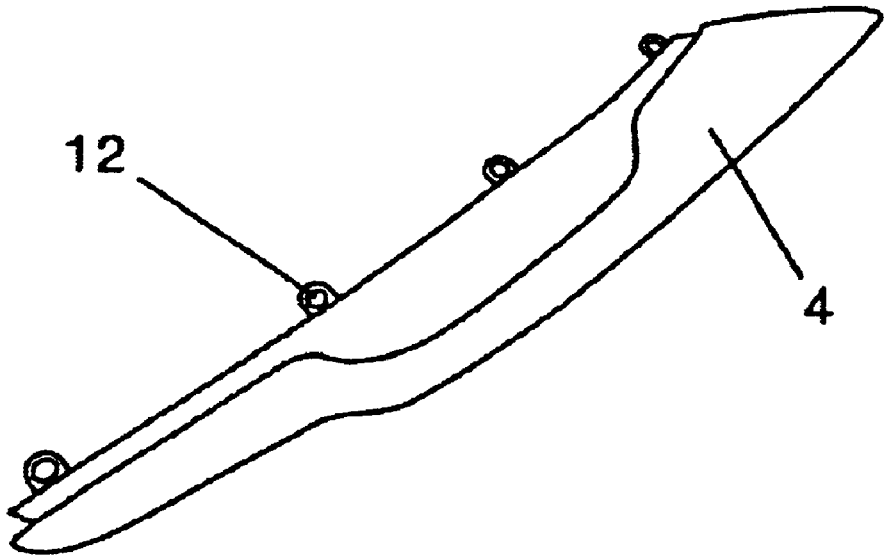
FIG. 7 illustrates a first shape rail panel.
Figure 8:
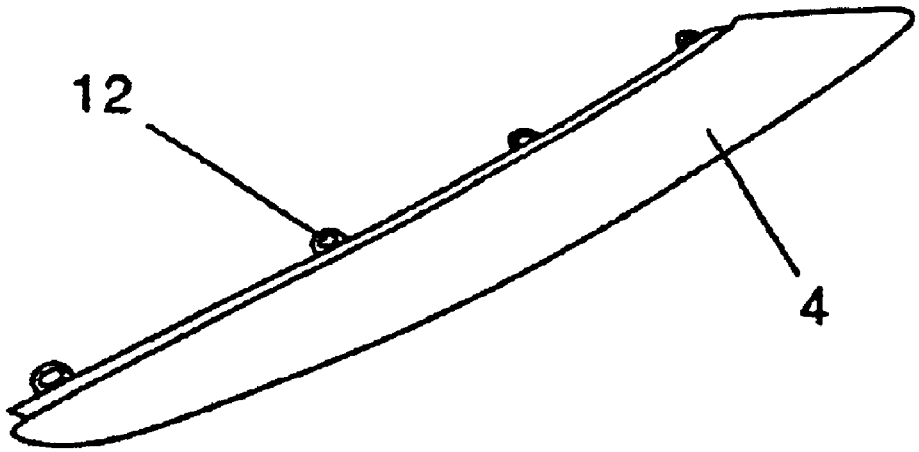
FIG. 8 illustrates a second shape rail panel.

In a board according to the invention the rail panels 3, 4 are changeable by the user/rider to alter the shape and performance characteristic of the board. This enables the board to be quickly and easily adapted to different rider skill levels, or different riding styles, or different water/wave conditions. Referring to FIGS. 7 and 8, the panels which change the performance more dramatically are the rails 3, 4.

FIG. 7 and a showed different rail panel designs respectively. In the preferred embodiment rail panels 3, 4 removably connect to the rear portion of core panel 1. This allows for quickly changing the characteristic of the board. The removable connection is via loops 12 that located within recesses 13 on the edges of core panel 1. Screws or plugs (not shown) extend from the lower surface through the loops 12 to hold the rails firmly in place. The screw or plug heads are recessed flush with the lower surface of the board. In alternative embodiments the rail panels 3, 4, are removably secured by snaps, screws, glue or other known means.

For performance boards the edges of. the main body panel 2, nose panel 5 and rail panels 3, 4 are hard. For beginner or inexperienced riders panels or portions of panels, and fins, may be made of a soft foam material. The panels can be changed as the rider gains experience.

The modular construction of the surfboard, and in particular the core panel 1, allows for precise control of the board shape in the side view, what is normally called rocker curve. The other panels are integrated or connected with the core panel 1, such as the rail panels 3, 4 or transparent panel 8. The core panel 1 can also incorporate after-market functional parts that are now common in the art. Such after-market functional parts include rubber grip mats for the back foot. These can be integrated into foot portion 7. They can also carry graphics and logos of the manufacturer in a more sophisticated way than on current surfboards, for example by way of embossed or debossed graphics.

It is envisaged that the invention may be embodied by rail panels 3,4 attached to a plastic system that integrate with known surfboard designs as they are being manufactured or as an after-market part for existing surfboards. As an after-market part the plastic system permanently mounts to the existing surfboard and the rail panels are removably connected to the plastic system for quickly altering the shape and performance characteristics of the board. The plastic system attaches in the same way known fin cassettes are glued or laminated into the board or it is incorporated into mass-produced surfboards.

Thus according to the invention there is provided a water sports board that is adaptable to different performance and/or handling characteristics.

Where in the foregoing description reference has been made to methods or elements have known equivalents then such are included as if individually set forth herein.

Embodiments of the invention have been described, however it is understood that variations, improvement or modifications can take place without departure from the spirit of the invention or scope of the appended claims.

What is claimed is:

1. A water sports board system comprising:

a main body panel having a left edge, a right edge, and a front edge, the main body panel having a predetermined performance characteristic; and a plurality of pairs of rail members, each pair having a predetermined performance characteristic, each rail member having an inside edge and an outside edge, wherein a pair of rail members selected from the plurality of pairs of rails are adapted to be removably attached to a rear portion of the main body panel by attaching the inside edge of one rail member to the left edge of the main body panel and the inside edge of another rail member to the right edge of the main body panel, the attached rail members and main body panel together having a substantially surfboard shape.

2. The water sports board system of claim 1, wherein the main body panel comprises:

a core portion having a left edge, a right edge, and a front edge, the core portion having a predetermined performance characteristic; and a substantially u-shaped member having an inside edge and an outside edge, the member having a predetermined performance characteristic, the member adapted to be coupled to a front portion of the core portion by attaching the inside edge of the member to the front edge and portions of the left edge and right edge of the core portion, so as to form a substantially continuous boundary including the outside edge of the member and portions of the left edge and right edge of the core portion not attached to the member.

3. The water sports board system of claim 2, wherein the substantially u-shaped member is selected from a plurality of different types of substantially u-shaped members, each type having a different predetermined performance characteristic.

4. The water sports board system of claim 2, wherein the substantially u-shaped member is unitary.

5. The water sports board system of claim 2, wherein the substantially u-shaped member includes two or more segments.

6. The water sports board system of claim 2, wherein the substantially u-shaped member is permanently coupled to the front portion of the core portion.

7. The water sports board system of claim 2, wherein the substantially u-shaped member is removably coupled to the front portion of the core portion.

8. The water sports board system of claim 1, wherein the attached rails and main body panel form a substantially smooth curving outer edge.

9. The water sports board system of claim 1, wherein the main body panel further has one or more cavities embedded therein, the one or more cavities adapted to receive one or more rail members.

10. The water sports board system of claim 1, further comprising:

a nose panel, having a predetermined performance characteristic and having an inside edge and an outside edge, the nose panel adapted to be removably attached to a front portion of the main body panel by removably attaching the inside edge of the nose panel to the front edge of the main body panel, to form a substantially continuous boundary including the outside edge of the nose panel and portions of the front edge of the main body panel not attached to the nose panel.

11. The water sports board system of claim 1, further comprising one or more fins removably coupled to the main body panel.

12. The water sports board system of claim 1, further comprising one or more fins removably coupled to the rail members.

13. The water sports board system of claim 1, wherein the main body panel includes a transparent portion.

14. A method of manufacturing a water sports board, comprising:

selecting a substantially u-shaped member, the member having an inside edge and an outside edge, and a predetermined performance characteristic;

selecting a core portion, the portion having a left edge, a right edge, and a front edge, the portion having a predetermined performance characteristic;

coupling the inside edge of the member to the left, right, and front edges of the portion to form a main body; and packaging the main body with a plurality of rail members that can be selectively removably attached to the main body by an end user prior to use of the main body, the attached rail members and main body together having a substantially surfboard shape.

15. The method of claim 14, wherein the substantially u-shaped member is unitary.

16. The method of claim 14, wherein the substantially u-shaped member includes two or more segments.

17. The method of claim 14, wherein coupling the inside edge of the member to the left, right, and front edges of the portion to form a main body comprises permanently coupling.

18. The method of claim 14, wherein coupling the inside edge of the member to the left, right, and front edges of the portion to form a main body comprises removably coupling.

19. The method of claim 14, wherein the main body has one or more cavities embedded therein, the one or more cavities adapted to receive one or more rail members.

20. The method of claim 14, further comprising:

packaging the main body with a nose panel that can be selectively removably attached to the main body by an end user prior to use of the main body.

21. The method of claim 14, further comprising:

packaging the main body with one or more fins that can be selectively removably attached to the main body by an end user prior to use of the main body.

22. The method of claim 14, further comprising:

packaging the main body with one or more fins that can be selectively removably attached to the rail members by an end user prior to use of the main body.

23. The method of claim 14, wherein the main body includes a transparent portion.

24. A rail system comprising:

a plurality of pairs of rail members, each pair having a predetermined performance characteristic; and a harness adapted to be coupled to a water sports board, the harness having one or more cavities embedded therein, the one or more cavities adapted to receive one or more rail members, the water sports board, coupled harness, and received rail members together having a substantially surfboard shape.

25. The rail system of claim 24, wherein the harness is removably coupled to the water sports board.

26. The rail system of claim 24, wherein the harness is permanently coupled to the water sports board.

27. The rail system of claim 24, wherein the harness is plastic.

* * * * *